United States Patent [19]

Chauve et al.

[11] Patent Number: 4,716,898

[45] Date of Patent: Jan. 5, 1988

[54] STIMULATION DEVICE FOR ACUPUNCTURE POINTS

[76] Inventors: Jean-Yves Chauve, 11 Allée des Camélias, 44350 Guerande; Jean M. Leguin, 52 Avenue de Gaulle; Jacques Loquet, 31 Avenue de Gaulle, both of 44380 Pornichet; Leroux Eugene, Rue du Bel Air, 50470 La Glasserie, all of France

[21] Appl. No.: 909,299

[22] Filed: Sep. 19, 1986

[30] Foreign Application Priority Data

Mar. 6, 1986 [FR] France ..... 86 04331

[51] Int. Cl.[4] ..... A61H 11/00

[52] U.S. Cl. ..... 128/329 A; 128/67; 128/327

[58] Field of Search ..... 128/60, 67, 97, 99, 128/100, 111, 112, 116, 163, 165, 169, 303 R, 327, 329 A

[56] References Cited

U.S. PATENT DOCUMENTS

| | | | |
|---|---|---|---|
| 102,072 | 11/1936 | Woodside | 128/67 |
| 1,481,354 | 1/1924 | Dingfeld . | |
| 3,297,028 | 1/1967 | Murray | 128/165 |
| 4,308,861 | 1/1982 | Kelly | 128/329 A |
| 4,323,232 | 4/1982 | Terpening | 128/329 A |
| 4,479,495 | 10/1984 | Isaacson | 128/327 |
| 4,590,939 | 5/1986 | Sakowski | 128/329 A |
| 4,632,095 | 12/1986 | Libin | 128/60 |

FOREIGN PATENT DOCUMENTS

| | | |
|---|---|---|
| 2619410 | 11/1976 | Fed. Rep. of Germany . |
| 2621992 | 12/1976 | Fed. Rep. of Germany . |
| 2352539 | 12/1977 | France . |
| 2089217 | 6/1982 | United Kingdom . |

*Primary Examiner*—Dalton L. Truluck
*Assistant Examiner*—Frank Wilkens
*Attorney, Agent, or Firm*—Young & Thompson

[57] ABSTRACT

A stimulation device of an acupuncture point comprising a stimulation member acting by pressure, rigidly connected to an element adapted for maintaining the member pressed on the portion of the body where the acupuncture point in consideration is situated. The pressure member of the stimulation member is surrounded by a peripheral ridge adapted for bearing on the skin and provided for limiting its driving in the central pressure member which is adapted for coming to bear on the acupuncture point being rigidly connected at its periphery to a resiliently deformable crown of general convex shape which causes, by a driving in of the central region rigidly connected to the central pressure member, the formation of a protruding annular crown the circular ridge of which forms a bearing line surrounding the pressure member.

7 Claims, 6 Drawing Figures

STIMULATION DEVICE FOR ACUPUNCTURE POINTS

TECHNICAL FIELD

The present invention relates to a stimulation device providing a massage of acupuncture points. It is known that it is possible to avert or treat certain health troubles by stimulating said acupuncture points. It is also known that the stimulation of acupuncture points can be obtained not only with traditional needles but also by a massage.

BACKGROUND OF PRIOR ART

According to the prior art, for example according to U.S. Pat. No. 1,481,354, a bracelet or band is known, which comprises on its surface which is adapted for coming in contact with the area surrounding the acupuncture point, at least one half-sphere in a hard non resilient material. The bracelet is made of a non resilient material, the half-sphere being applied by its flat face on the bracelet inner surface. The half-sphere exerts a crushing action and not a massage on the defined acupuncture point. This device does not give satisfactory results due to the fact that the bearing area is spread out over too wide a surface in the vicinity of the sensitive point and that the bearing pressure depends only on the bracelet tightening intensity, a correct tightening causing on the skin a hard and violent pressure which is difficult to support. On the other hand, the smooth and sliding surfaced half-sphere has a tendency to side-slip easily on the skin during the movements, which makes impossible to obtain the effect looked after.

The applicants have proposed to replace the half-sphere by a cone or troncated cone of a resiliently deformable material, the rounded point of which stimulating selectively the determined acupuncture point and enhancing the maintenance in position and therefore the efficiency of the stimulation.

On the other hand, the cone exerts, via its rounded point, a deep punctual pressure on the point to stimulate. Moreover, due to its resiliency, the cone which is deformed by the pressure exerted by the band develops a pushing force in order to return to its initial shape, which constitutes an extra important component of the stimulation.

Finally, due to the resiliency of the pressure member, the pressure varies according to the movements of the limb and the contractions of the muscles in the area where the pressure member is situated. Thereby results an accentuation of the massage effect of the sensitive point, which means a very advantageous disposition for reaching the effect looked after. It has also been proposed to use several stimulation cones on the same fixation band, said cones comprising at their base a self-hooking pellet the complementary element of which is carried by a cushion adapted on the fixation band. The position of the stimulation cones on the same cushion can thus be modified in order to be adapted to each morphology. The cushion is made of a deformable and resilient material, as is the fixation band. One end of the band is fixed to the cushion, the other end passes in a baffle made in the thickness of the cushion in order to ensure the tightening. This device brings about the possibility of multiplying the points to be stimulated in the same region and of adapting itself to each particular morphology. The fact that it is made of a deformable resilient material contributes to the massage of the point, limits the sliding motion and improves the confort. Yet, when the application is made during a more or less lengthy periods, there appear painfull phenomena or skin reactions resulting from a tightening intensity which is too high, in turn connected to the necessity of maintaining by such a tightening a correct permanent positioning of the cone. Indeed, if the tightening is insufficient, the cone would be likely to move and would not therefore apply a stimulation sufficiently precise on the determined point. Moreover, the fixation mode would not allow reaching efficiently certain points to be stimulated.

In DE-A-No. 2 621 992 has been proposed to surround the frustoconical element effecting the massage of the acupuncture point by a flat concave centering cupel. The part played by this cupel is not explained and the material of which it is made is neither indicated, but it seems that its role is to maintain constant the driving in of the pressure member, and therefore the pressure, the cupel bearing via its rim on the area surrounding the acupuncture point. With this device, the pressure exerted by the pressure member and the cupel rim on the skin is determined by the tightening provided by the fixation ring and this pressure depends on the tightening intensity, the pressure member and the cupel having no resiliency of their own.

OBJECTS AND SUMMARY OF THE INVENTION

The invention has in particular for object to eliminate said disadvantages of the pressure acupuncture devices previously known and to provide a device ensuring a massage of the acupuncture point rather than a pressure.

According to the invention, in a stimulation device of an acupuncture point comprising a stimulation member acting by pressure and rigidly connected to an element adapted for maintaining said member pressed on the portion of the body where the acupuncture point in consideration is situated, the pressure member of said stimulation member being surrounded by a peripheral ridge adapted for bearing on the skin and for limiting its driving in, the stimulation member acting by pressure is characterized in that its central pressure member, adapted to bear on the acupuncture point, is rigidly connected at its periphery to a resiliently deformable crown of general convex shape which causes, due to the driving in of the central region which is rigidly connected to the central pressure member, the formation of a protruding annular crown the circular ridge of which forms a bearing line surrounding the pressure member.

Preferably, the deformation of the resiliently deformable peripheral crown is such that the circular ridge comes to bear on the skin when the central pressure member exerts on the acupuncture point substantially the determined pressure providing the efficiency of the device.

In a diametrical section, the central pressure member made of a material exhibing a resilient deformation has, preferably, a substantially frustoconical or cylindrical section, with a rounded point of greater thickness which is connected by its edges, via a region of less thickness forming a hinge, to a peripheral crown of convex section, the edge of which is ridigly connected to a base which is substantially radially non-extensile.

According to a preferential embodiment, the peripheral crown has the shape of a dome, with at its base a peripheral belt, and the top of the dome carries a protruding element with a point in the shape of a spherical cap.

The stimulation device acting by pressure can be molded integrally of a resilient material with the fixation band forming the positioning and pressure maintenance element. Due to its resiliency proper which allows compensating slight volume variations under the effect of the muscular effort of the portion of the body where the acupuncture point is situated, the stimulation device can be fixed by its base on a more or less rigid band, for example on a base fixed on said band.

According to a feature of the invention, the stimulation device acting by pressure is protruding on the adhesive face of a surface exhibiting an adhesive power to the skin.

When the stimulation device according to the invention is fixed via its base and in a removable manner on the positioning maintenance band as described in U.S. Pat. No. 1,481,354, the possibility of setting the position includes a possibility of setting the position transversely to the band in order to allow positiong the bearing member on an acupuncture point offset with respect to the region of the limb having the minimum circumference. In this embodiment, the band carries a base formed on the face directed toward the skin with a slot which is transverse or oblique with respect to the longitudinal direction of the band, and the stimulation member acting by pressure is carried by a base forming a slide cooperating with said slot. Preferably, the slot has a dovetail-shaped section. Preferably also, the base and the slide are provided on their cooperating surfaces with bulges resiliently fitting into each other and providing the maintenance in position of the slide on the base formed with a slot.

The band can include several bases such as hereabove for simultaneously stimulating several contiguous acupuncture points, or the same base can include several slots for receiving several slides carrying each a stimulation member acting by pressure.

When the point to be stimulated is situated in a zone where the band surrounding the body portion has to pass above a protrusion, for example when the band surrounding the ankle has to pass on the calcaneum, the band can be rigidly connected to a fixed or sliding cup adapted for fitting around said protrusion.

The advantages of the device result substantially from the fact that the stimulation member provides a massage action and not a crushing action due to the resilient mobility of the pressure member with respect to the peripheral crown. The limitation and the resilient control of the bearing pressure provided by the abutment formed by the portion protruding from the peripheral crown allows avoiding the painful phenomena and reducing the tightening force of the fixation band, which can be replaced by a surface adhering to the skin. The maintenance in position, even in the case of a band with a limited tightening, is distinctly improved owing to the increase of contact surface provided by the protruding portion of the peripheral crown.

BRIEF DESCRIPTION OF THE DRAWINGS

The invention will be described hereafter in more detail, with reference to the accompanying drawings wherein.

DETAILED DESCRIPTION OF THE INVENTION

Figure 1:
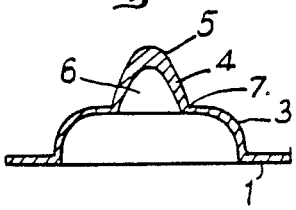
FIG. 1 is a diametrical sectional view of the stimulation member, in a free state.

The stimulation device of an acupuncture point according to the invention comprises a peripheral base 1 which can be an integral part of a tighetening band or of a bearing plate 2, or fixed on said band or plate. Such a base is formed with a circular central orifice from the edge of which extends a dome-shaped wall 3 at the top of which is fixed the pressure member as such 4, which has a general frustoconical or cylindrical shape with a rounded top 5. The pressure member 4 can be massive or, as shown, hollow, with a wall thickness more important at the top 5. The stimulation device assembly can be homogeneous and made of rubber or a plastics material exhibiting a resilient deformation. An insert in a harder material can be fixed for forming pressure member 4, only the top 5 of the latter, or in order to fill the inner space 5 for increasing the rigidity thereof.

Figure 2:
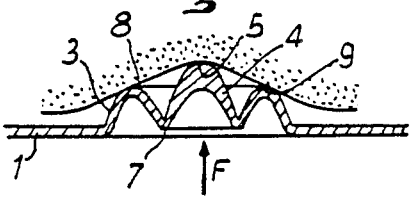
FIG. 2 is a diametrical sectional view of the stimulation member bearing on the skin.
Figure 6:
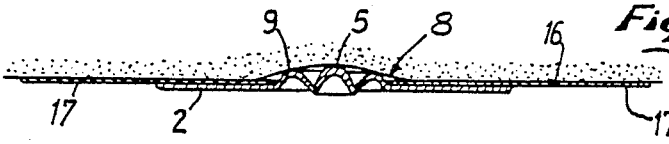
FIG. 6 is a view corresponding to FIG. 4, after application on the skin.

Junction 7 between the inner edge of the dome-shaped wall 3 and the pressure member 4 forms a hinge, and when the pressure member is set under pressure on the skin 8, the dome-shaped wall 3 drives in resiliently as shown in FIGS. 2 and 6, the medium annular portion 9 of wall 3 coming in contact with the skin.

It is conceivable that due to the resiliency of its constituent material, the dome-shaped wall 3 has a tendency to resume its initial shape and to push, along arrow F, top 5 of pressure member 4 in order to bear on the skin 8. The contact line provided by circle 9 improves the maintenance in position of the device due to the fact that it comes to bear in the cup created by the deformation of the skin and that it distributes also over a larger surface the total pressure, thereby avoiding painful effects.

Figure 3:
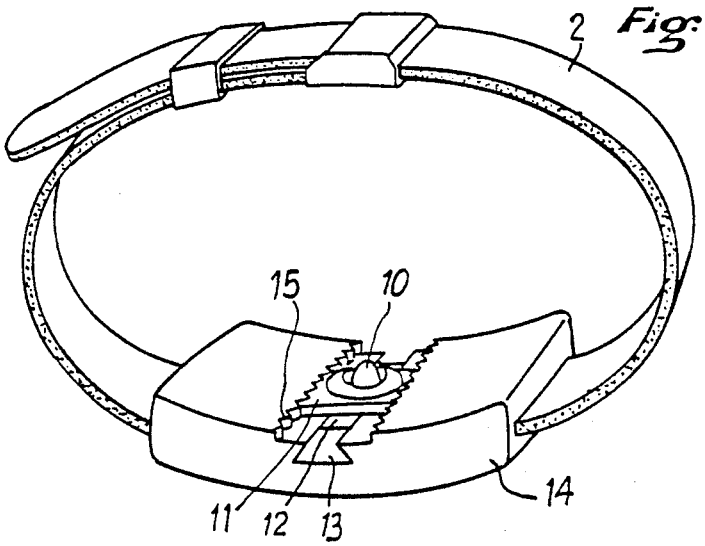
FIG. 3 is a perspective view of the stimulation member mounted so that its position can be adjusted on a band or bracelet.
Figure 5:
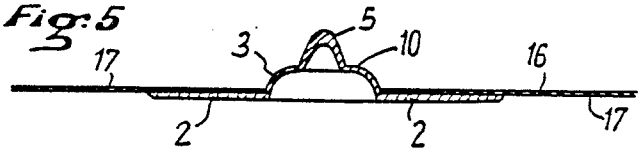
FIG. 5 is a sectional view along line V—V of FIG. 4.

In the embodiment of FIG. 3, the stimulation device designated as a whole at 10 is shown on a slide 11 which is mobile transversely to the length of fixation band 2, by a sliding motion of a dovetail-shaped rib 12 formed on the dorsal face in a slot 13 of same shape formed in a cushion 14 fixed to band 2. In order to ensure the maintenance in position of slide 11 on cushion 14, the side edges of the slide and the corresponding edges of the cushion slot are each formed with a teething 15 meshing resiliently with each other.

Figure 4:
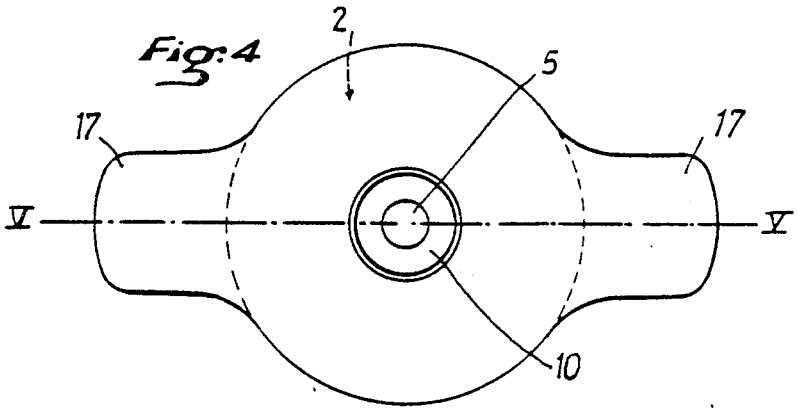
FIG. 4 is a plan view of the stimulation member mounted on a surface adapted for adhering to the skin.

In the embodiment of FIGS. 4 and 6, plate 2 is a circular plate forming also the base 1 of the stimulation device, and said plate 2 is glued or welded on the outer surface of a piece of fabric or a similar sheet of material 16 the inner face of which is coated with an adhering product adapted to skin 8. Sheet 16 is formed with a central cut-out from which protrudes the stimulation device 10 and it has two diametrically opposite lugs 17 allowing tensioning correctly the central portion prior to the final glueing. Prior to be put in position, the adhering surface can be protected by a removable film.

We claim:

1. A stimulation device for an acupressure point comprising a member acting by pressure and means for maintaining said member pressed on the body where the acupressure point is located, said member comprising a hollow semi-dome portion made of a resiliently deformable material, and a hollow-finger portion extending from the top of said semi-dome portion and extending centrally inward of said maintaining means, said finger portion having thicker walls than said semi-dome portion, said semi-dome portion partially collapsing in a partially everted manner when pressure is applied to said finger portion, said partially everted semi-dome portion forming an annular ridge, surrounding said finger portion, all of which bear against the body to stimulate the affected area.

2. A device as claimed in claim 1, having a peripheral flange by which said device is secured to said maintaining means.

3. A device as claimed in claim 1, which is of molded construction.

4. A device as claimed in claim 1, in which said maintaining means has an adhesive surface for contact with the skin of a patient.

5. A device as claimed in claim 1, in which said maintaining means comprises a band, said band carrying a base which, on the surface thereof directed toward the skin of the patient, has a slot which is transverse to the length of the band, said member being slidably carried in said slot.

6. A device as claimed in claim 5, there being a dovetail connection between said member and said base.

7. A device as claimed in claim 6, and resilient teeth on said dovetail connection releasably maintaining said member in predetermined positions along said slot.

* * * * *